US009003831B1

(12) United States Patent
Azar et al.

(10) Patent No.: US 9,003,831 B1
(45) Date of Patent: Apr. 14, 2015

(54) JEWELRY COMPRISING MAGNETICALLY COUPLED ELEMENTS

(71) Applicant: HB Concepts, LLC, Springfield, MA (US)

(72) Inventors: Petra Azar, New Hope, PA (US); Camile Hannoush, Springfield, MA (US)

(73) Assignee: HB Concepts, LLC, Springfield, MA (US)

( * ) Notice: Subject to any disclaimer, the term of this patent is extended or adjusted under 35 U.S.C. 154(b) by 0 days.

(21) Appl. No.: 14/134,827

(22) Filed: Dec. 19, 2013

(51) Int. Cl.
*A44C 25/00* (2006.01)

(52) U.S. Cl.
CPC ..... *A44C 25/001* (2013.01); *A44C 25/005* (2013.01); *Y10T 24/32* (2013.01)

(58) Field of Classification Search
CPC ..... A44C 25/001; A44C 25/005; Y10T 24/32
USPC ..... 63/29.2, 23, 40
See application file for complete search history.

(56) References Cited

U.S. PATENT DOCUMENTS

| | | | | |
|---|---|---|---|---|
| 3,034,320 | A * | 5/1962 | Feibelman | 63/14.1 |
| 3,129,477 | A * | 4/1964 | Mizuno | 24/303 |
| 4,052,864 | A * | 10/1977 | Hofsaess | 63/31 |
| 4,231,137 | A * | 11/1980 | Fujimoto | 24/303 |
| 5,572,887 | A * | 11/1996 | Geswelli | 63/3 |
| 5,806,346 | A * | 9/1998 | Schlinger et al. | 63/40 |
| 5,845,373 | A * | 12/1998 | Langer | 24/303 |
| 6,594,871 | B2 * | 7/2003 | Hoffman | 24/303 |
| 6,715,315 | B1 * | 4/2004 | Hartgrove | 63/29.2 |
| 7,207,091 | B2 * | 4/2007 | Dunaye | 24/303 |
| 7,216,508 | B2 * | 5/2007 | Kretchmer et al. | 63/35 |
| 7,571,623 | B2 * | 8/2009 | Kretchmer et al. | 63/3 |
| 8,596,090 | B1 * | 12/2013 | Smith | 63/29.2 |
| 8,640,266 | B2 * | 2/2014 | Best et al. | 2/321 |
| 2007/0209391 | A1 * | 9/2007 | Tamir et al. | 63/40 |
| 2010/0101274 | A1 * | 4/2010 | Worth | 63/40 |
| 2012/0131953 | A1 * | 5/2012 | Fahsel | 63/29.2 |

FOREIGN PATENT DOCUMENTS

GB 1483700 A * 8/1977

* cited by examiner

*Primary Examiner* — Emily Morgan
(74) *Attorney, Agent, or Firm* — Levisohn Berger LLP

(57) ABSTRACT

An item of jewelry is formed by solely using magnetic attraction to connect the elements together in which the elements or components comprise substantially planar surfaces, generally matching in which the elements are held together by magnetic attraction and further include finger projections integrally formed therewith permitting separation of the components.

3 Claims, 4 Drawing Sheets

JEWELRY COMPRISING MAGNETICALLY COUPLED ELEMENTS

BACKGROUND OF THE INVENTION

The invention relates to a new and novel apparatus and method for assembly of jewelry having substantially planar surfaces with sufficient matching portions to enable magnetic attachment.

Jewelry with planar surfaces having aesthetic appearances are generally slightly larger than very small jewelry, but the assembly and joining of the elements of a jewelry item can be time consuming, labor intensive and require highly skilled personnel. Techniques such as soldering to connect individual components of jewelry requires manual dexterity and skill, and such dexterity and skill often is possessed by limited specialists in the field.

An object of this invention is to provide a novel structure and method for assembling components of jewelry without requiring highly skilled personnel and specialized techniques.

Another object of this invention is to provide a system for creating such jewelry which may be easily assembled, relatively error free because of the structure of the individual components forming the jewelry.

Still another object of this invention is to provide such a jewelry structure and method of assembly which is particularly directed toward planar portions of jewelry components intended to mate with other planar components to form the jewelry.

Other objects, advantages and features of this invention will become more apparent from the following description.

SUMMARY OF THE INVENTION

In accordance with the principles of this invention, jewelry formed of planar surfaces of components adapted to mate with other planar components of the jewelry utilizes magnetic attraction substantially perpendicular to the planes of the planar surfaces to assemble the individual components together.

Assembly of such planar components with magnetic attraction between the respective components permits easy and facile assembly of the jewelry without the requirement for complex structural joining techniques such as soldering and the like.

The magnetic attraction between the planar elements is sufficient such that the elements are held together flawlessly without separating, and means to assist in the separation of the elements, when desired, are also provided.

DETAILED DESCRIPTION OF PREFERRED EMBODIMENTS

Broadly, the invention comprises a plurality of planar components which are held together by magnetic attraction perpendicular to the plane of the components themselves.

Figure 1:
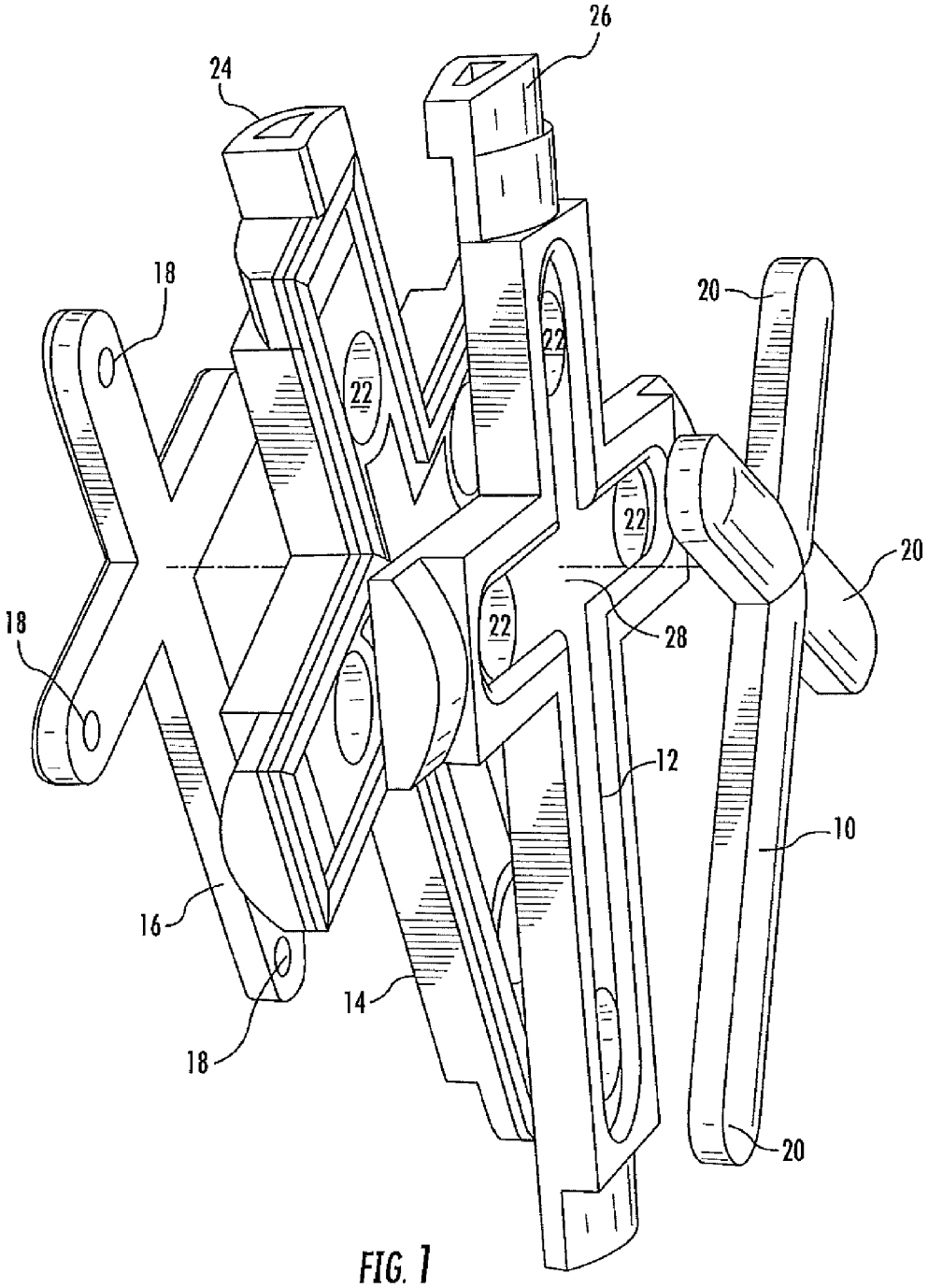
FIGS. 1-3 are exploded perspective views showing different stages of a first embodiment of this invention in which the components to assemble the jewelry comprise matching planar faces for enabling magnetic attraction to hold the components together.
Figure 2:
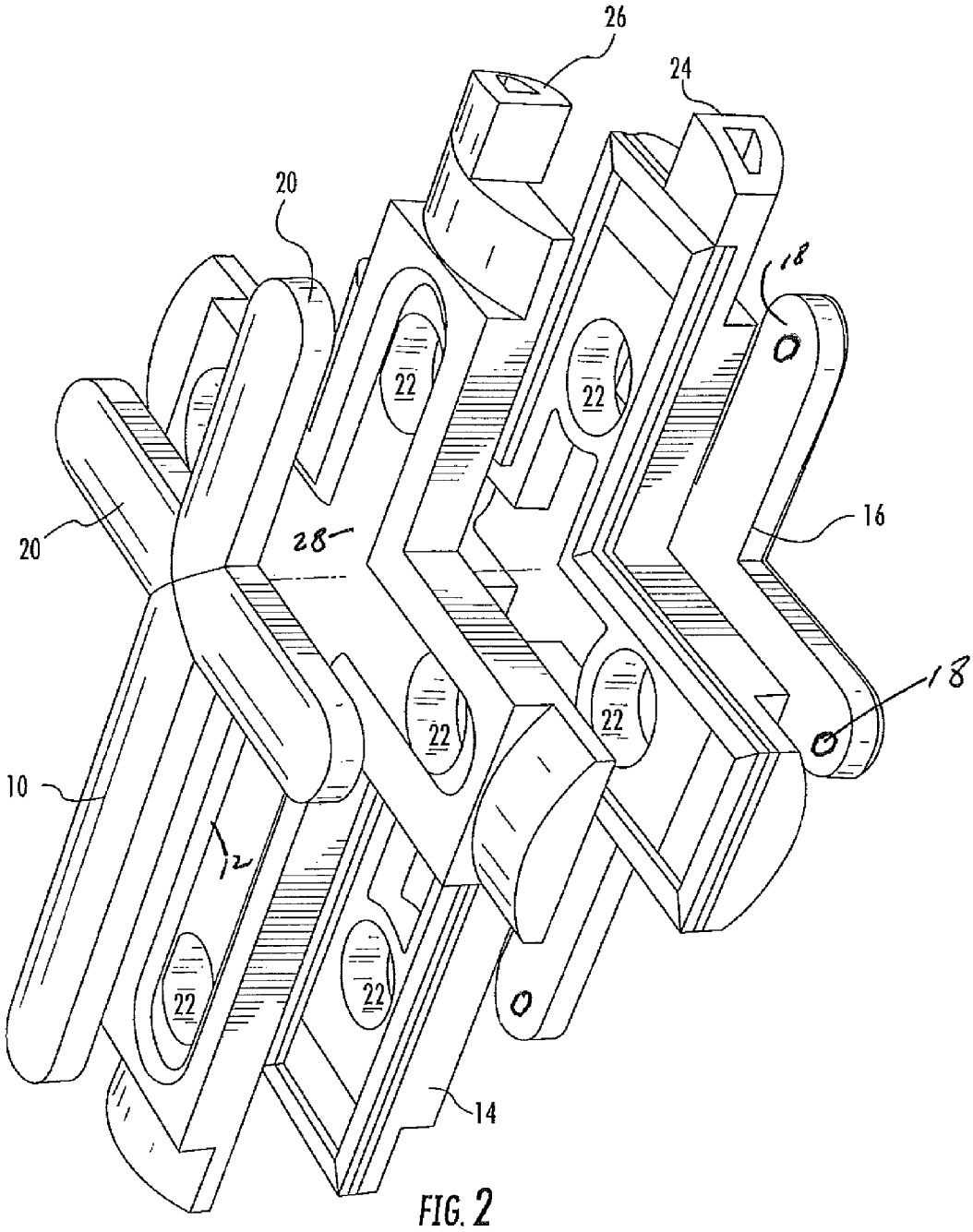
Figure 3:
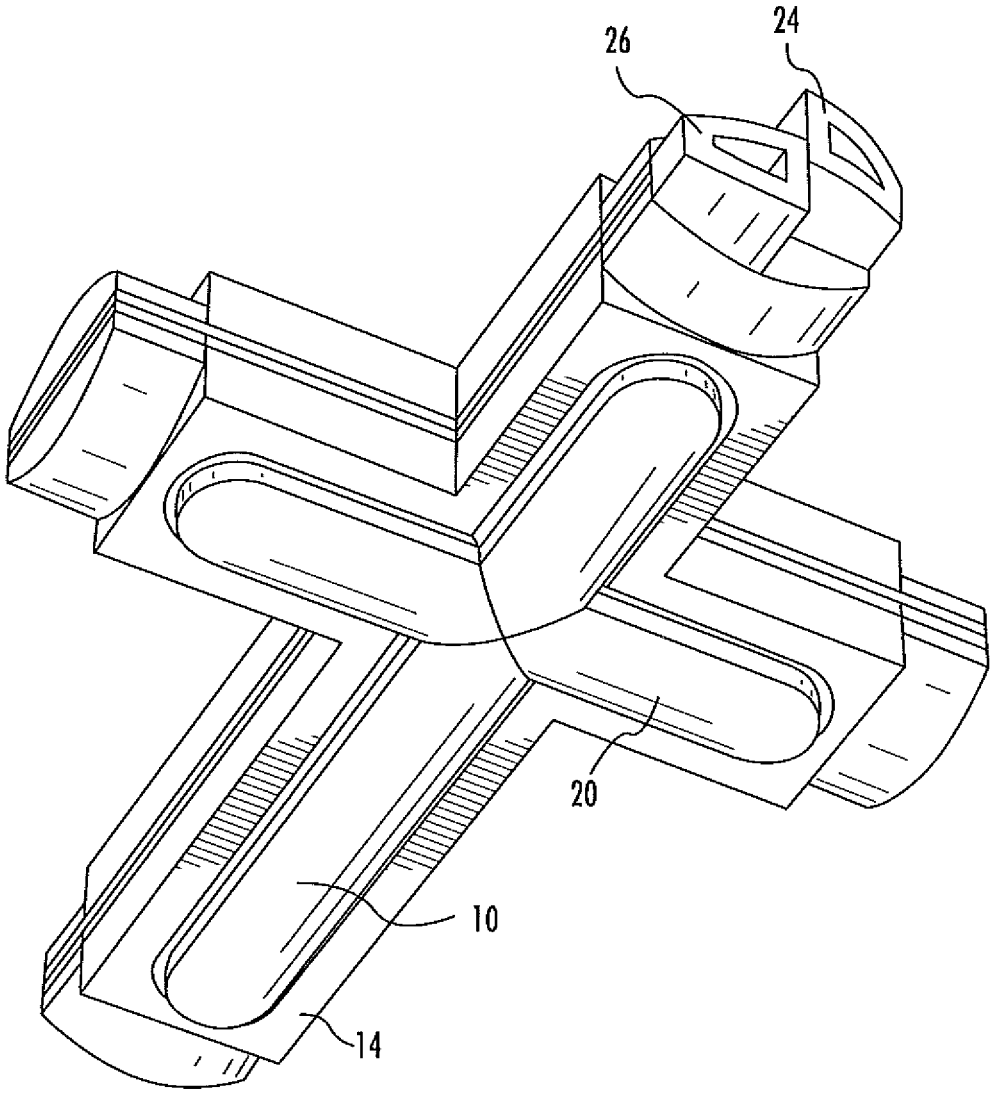

Referring to FIGS. 1-3, there are four separate components, 10,12, 14 and 16, and components 10 and 16 are attracted to each other through respective magnetic elements 18 in section 16, which is aligned with magnetic elements 20 (not shown) in section 10.

Apertures 22 in intermediate components 12 and 14 are aligned with magnetic elements 18 and 20 so that the four-component cross jewelry item shown in FIGS. 1-3 may be quickly and easily assembled.

Top component 10 fits within a recess 28 in section 12, which further ensures that the cross remains in place. Additionally, rear cross 16 fits in a recess (not shown) in the rear of component 16 so that the outer cross elements 10 and 16 securely fit within respective recesses.

While components 10, 12, 14 and 16 have substantial matching planar surfaces, the magnetic assembly structure and technique of this invention merely requires that the magnetic elements 18 and 20 be aligned with each other either directly or through apertures, such as 22 so as to enable perpendicular assembly through magnetic attraction of the individual components of such jewelry.

In accordance with a feature of this invention, intermediate sections 12 and 14 have integral projections 24 and 26 extending beyond the silhouettes of said components formed at their respective tops which may be moved by manual pressure perpendicularly or in any other direction to separate the four components from each other, enabling disassembly of the cross of FIGS. 1-3. Such disassembly may be for cleaning, replacement or any other desired activity regarding the individual components which make up the magnetically connected jewelry component assembly of this invention. The projections 24 and 26 may project from any portion of the jewelry so long as they are located sufficiently proximate to each other to permit perpendicular separation of the components.

Magnetic elements 18 and 20 are located in planar surfaces in respective sections 10 and 16. Although it is not necessary that the facing surfaces of the components be flat, it is only necessary that the magnetic elements 18 and 20 be aligned with each other through apertures in any intermediate sections such as 12 and 14 so that the entire magnetic structural assembly may be easily assembled and held that way through magnetic attraction.

The jewelry of the present invention may be formed of precious metal, non-precious metal or any other desired materials, and the principal unifying aspect of this invention is that the sections which are to be joined through magnetic attraction have clear line of sight between the magnetic elements so that any intermediate sections are held therebetween securely as shown in FIGS. 1-3. Additionally, one may not need two magnetic elements, but only one with the other element being magnetically attractable.

The shapes of finger projections 24 and 26 are left to individual aesthetic tastes, but the functional aspect is that these projections enable relatively free access to separate magnetically assembled jewelry items.

FIGS. 4A-4E are views of another embodiment of this invention in which the elements joined by magnetic assembly are decorative "S" shaped sections. The embodiment shown in FIGS. 4A-4E comprises only two components held together by magnetic attraction, and the central aspect of this embodiment as well as FIGS. 1-3 is that the magnetic elements holding the components together is through magnetic attraction perpendicular to the planar surfaces.

Elements 40 and 42 are matching "S" shapes with matching silhouettes and include magnetic members 44 in section 40 and magnetic elements held in recess 46 in section 42 so that when the two S sections are placed face to face, magnetic attraction between magnetic elements is achieved.

Figure 4A:
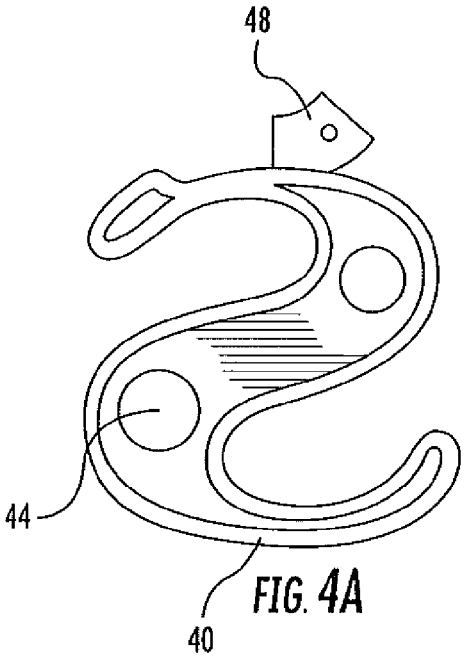
FIG. 4A is a bottom view of an element of a two piece magnetic assembly jewelry item.
Figure 4B:
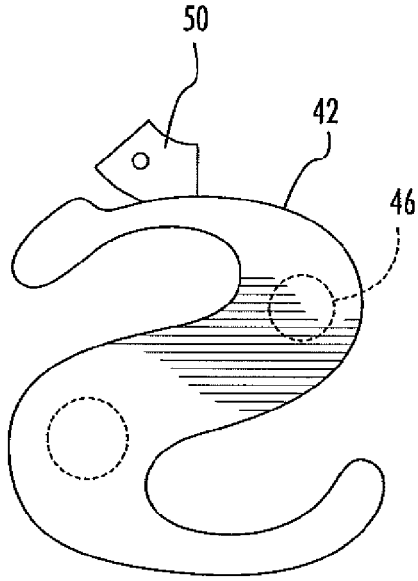
FIG. 4B is a top view of the second element of the two piece item of FIG. 4A.
Figure 4C:
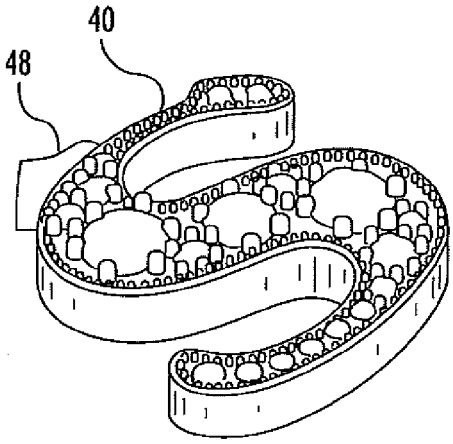
FIG. 4C is a top perspective view of the item of FIG. 4A.
Figure 4D:
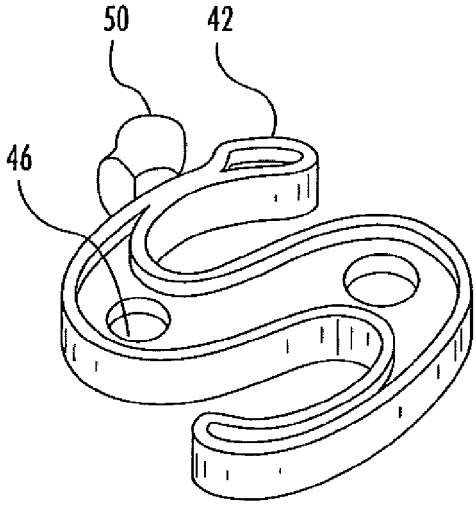
FIG. 4D is a bottom perspective view of the element of FIG. 4B.
Figure 4E:
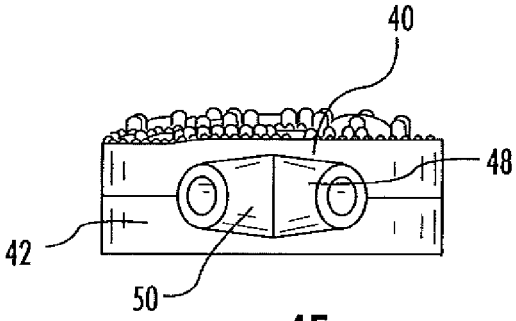
FIG. 4E is an end view of the elements connected together.

Finger projections 48 of element 40 and 50 of element 42 are integrally formed on top of the respective S elements enabling finger manipulation to separate the S elements from each other when desired. FIG. 4C is a perspective top view of element 40 with a decorated top thereof.

The perpendicular attraction of the planar surfaces of the jewelry structure shown in FIG. 4 as well as FIGS. 1-3 enables quick and easy assembly of the jewelry without requiring highly skilled personnel to attach and secure separate sections of the jewelry product together. Additionally, the magnetic assembly technique of this invention enables easy and quick separation of the separate components, when desired.

It should be understood that the preferred embodiment was described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly legally and equitably entitled.

The invention claimed is:

1. An item of jewelry assembled through magnetic attraction, comprising two outer components and two intermediate components, said outer components comprising respective magnetic elements aligned with and towards each other, said magnetic elements contained within said outer components, the magnetic elements being magnetically attracted to each other, said outer and intermediate components assembled together through the magnetic attraction of said magnetic elements, said intermediate components located between said outer components, said intermediate components comprising apertures aligned with said respective magnetic elements in said outer components, said apertures forming throughholes enabling magnetic attraction of said outer and intermediate components through said throughholes and assembly of said item of jewelry, said intermediate components having respective tops and said intermediate components comprising recesses facing respective ones of said outer components, respective ones of said outer components sitting in said respective recesses in said intermediate components, a projection extending on each of said tops of each of said intermediate components and integrally formed therewith, and said projections on top of one of said intermediate components being substantially adjacent to said projection on top of the other of said intermediate components, said projections located offset to each other capable of being pushed apart to separate said outer and intermediate components.

2. The item of jewelry as set forth in claim 1, wherein each of said intermediate components has matching silhouettes.

3. The item of jewelry as set forth in claim 2, wherein each of said outer components has matching silhouettes.

* * * * *